US005353439A

United States Patent [19]

Kurtz et al.

[11] Patent Number: 5,353,439

[45] Date of Patent: Oct. 11, 1994

[54] GOLF SCORING DEVICE

[76] Inventors: John G. Kurtz, 102 Hoffman Rd., Rochester, N.Y. 14622; Edward L. Zabelny, 198 Bayway Dr., Webster, N.Y. 14580

[21] Appl. No.: 972,217

[22] Filed: Nov. 5, 1992

[51] Int. Cl.[5] ..... D05B 19/00

[52] U.S. Cl. ..... 2/160; 116/225; 116/321; 273/32 B

[58] Field of Search ..... 2/160, 161.1, 161.2, 2/161.4; 116/222, 225, 321, 322, 324, 306, 307, 323, 309–312, 315, 223; 273/32 B, 183.1, DIG. 26, 187.2

[56] References Cited

U.S. PATENT DOCUMENTS

| | | | |
|---|---|---|---|
| 3,847,110 | 11/1974 | Inoue . | |
| 4,210,093 | 7/1980 | Baker | 116/222 |
| 4,498,668 | 2/1985 | Bowen | 116/324 X |
| 4,766,611 | 8/1988 | Kim | 2/160 |
| 4,912,307 | 3/1990 | Shade et al. | 116/324 X |
| 4,922,850 | 5/1990 | Conley | 116/321 X |
| 5,152,532 | 10/1992 | Rouse | 273/187.2 |

*Primary Examiner*—Clifford D. Crowder
*Assistant Examiner*—Paul C. Lewis
*Attorney, Agent, or Firm*—Frank A. Lukasik

[57] ABSTRACT

A system for attaching a scoring display unit to a fastening band of a glove. The fastening band includes a top strap, and a back surface patch for the top strap. Confronting surfaces of the top strap and the back surface patch comprise cooperating interengaging means, such as hooks and loops of VELCRO fabric. The scoring device of the invention is affixed to a strip of plastic and then cemented to a strip of hook VELCRO. The assembly is then placed over the top of a glove top strap and fastened to the loop VELCRO on the underside of the glove top strap. In a preferred embodiment, the scoring device consists of a flexible plastic strip and plastic beads connected thereto and together by a linkage of nylon thread. A second embodiment includes a rotary, numbered disc scoring device. The scoring device may also be affixed directly to the glove tab.

1 Claim, 6 Drawing Sheets

GOLF SCORING DEVICE

BACKGROUND OF THE INVENTION

1. Field of the Invention

This invention relates to a golf scoring device and more particularly to a system for attaching a golf scoring device to a glove, especially a golf glove to which the scoring device is securely fastened to the glove, yet easily removable.

2. Description of the Prior Art

Gloves used for sporting activities, such as golf gloves, include a fastening band comprised of top and bottom straps having confronting surfaces, such top and bottom straps typically being held together by the use of fabric hooks on one of the confronting surfaces, and fabric loops on another of such surfaces. Such fabric hooks and loops are currently available under the Trademark VELCRO.

Heretofore, devices and items of wearing apparel have been developed for holding golf accessories such as ball markers, watches, and tees. For example, U.S. Pat. No. 4,489,444 teaches a golf ball marker holder wherein the golfer wearing the glove may place a marker underneath the flap with the marker spike extending through an aperture through the flap and then the flap is folded down upon a pad where it is held in place.

U.S. Pat. No. 4,766,611 discloses a golf glove and watch combination that uses a conventional golf glove without modification. The watch strap feeds through retaining slots on the watch case and has VELCRO hooks on its surface facing away from the watch case. The strap extends partly around the glove flap so that the ends of the strap engage VELCRO loops on the underside of the flap. When the flap is pressed against a mating VELCRO pad, the watch is held securely in place.

U.S. Pat. No. 5,117,508 discloses a system for attaching a display unit to a glove including a first strap portion extending from the display unit and having an end region for insertion between the top and bottom straps of the glove and beneath the display unit. A second strap portion extends from an opposite side of the display unit and away from the display unit. A tack securing arrangement secures the second strap portion to the glove.

A typical golf scoring indicator is shown in U.S. Pat. No. Des. 205,077 which discloses score indicator beads sliding on a thread, the beads being held in place by depressions in the scoring board.

U.S. Pat. No. 3,124,806 discloses a golf training device having a pocket stitched on the glove to hold a weight which may be inserted therein. In another embodiment, a plurality of tubular compartments contain weights in the form of spheres.

Numerous types of golf scoring devices are available to assist the golfer in recording the score, stroke by stroke, until the hole is completed and the hole score is recorded on the score card. Such devices include the type shown in U.S. Pat. No. Des. 205,077, rotary dial counters, and a string of beads, for example. These devices are usually mounted on the handle of a golf cart, attached to a belt, or pinned to a golfer's clothing. Thus a player will often have to fumble about in trying to locate the scoring device right at a time when other players are waiting. The string of beads scorer is generally not used by male players and is generally used primarily by beginner golfers who have more strokes to remember. If a scoring device was devised to be both inconspicuous and readily available to the player as each stroke is made, more players, including the low scorers may also be interested in such a device.

SUMMARY OF THE INVENTION

Accordingly, it is an object of the invention to provide a system allowing a golfer to wear a scoring device on his or her wrist without having the scorer interfere with the golfer's swing.

It is another object of the invention to provide such a structure in the form of a scoring device attached to a glove in which the scoring device is securely fastened to the glove, yet is readily removable for use with another glove.

It is a still further object of the invention to provide a miniature attachable scoring device consisting of plastic beads connected together by a linkage of nylon thread.

It is yet another object of the invention to provide a miniature attachable scoring device consisting of an indicator dial.

The foregoing objects are realized by the present invention in a system for attaching a scoring display unit to a fastening band of a glove. The fastening band includes a top strap, and a back surface patch for underlying the top strap. Confronting surfaces of the top strap and the back surface patch comprise cooperating interengaging means, such as hooks and loops of VELCRO fabric. The scoring device of the invention is affixed to a strip of plastic and then cemented to a strip of hook VELCRO. The assembly is then placed over the top of a glove top strap of a glove and fastened to the loop VELCRO on the underside of the glove top strap.

BRIEF DESCRIPTION OF THE DRAWINGS

The foregoing and further objects of the invention will become apparent from reading the following detailed description of preferred embodiments of the invention, in which.

DETAILED DESCRIPTION OF THE INVENTION

Figure 3:
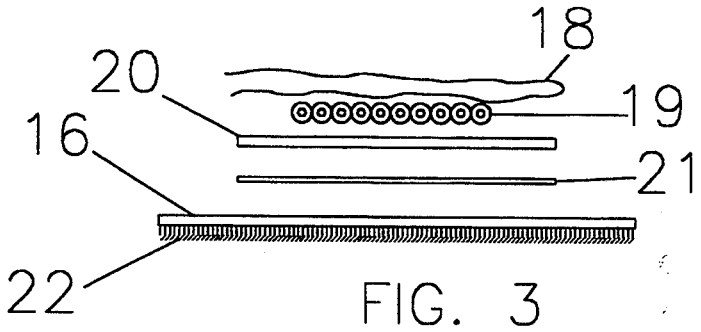
FIG. 3 is an exploded view of the scoring device of the invention.
Figure 4:
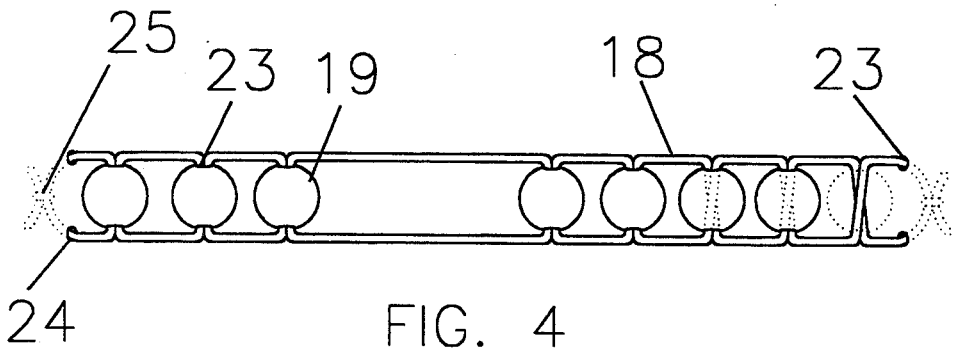
FIG. 4 is an assembly view of the scoring beads of the invention.
Figure 5:
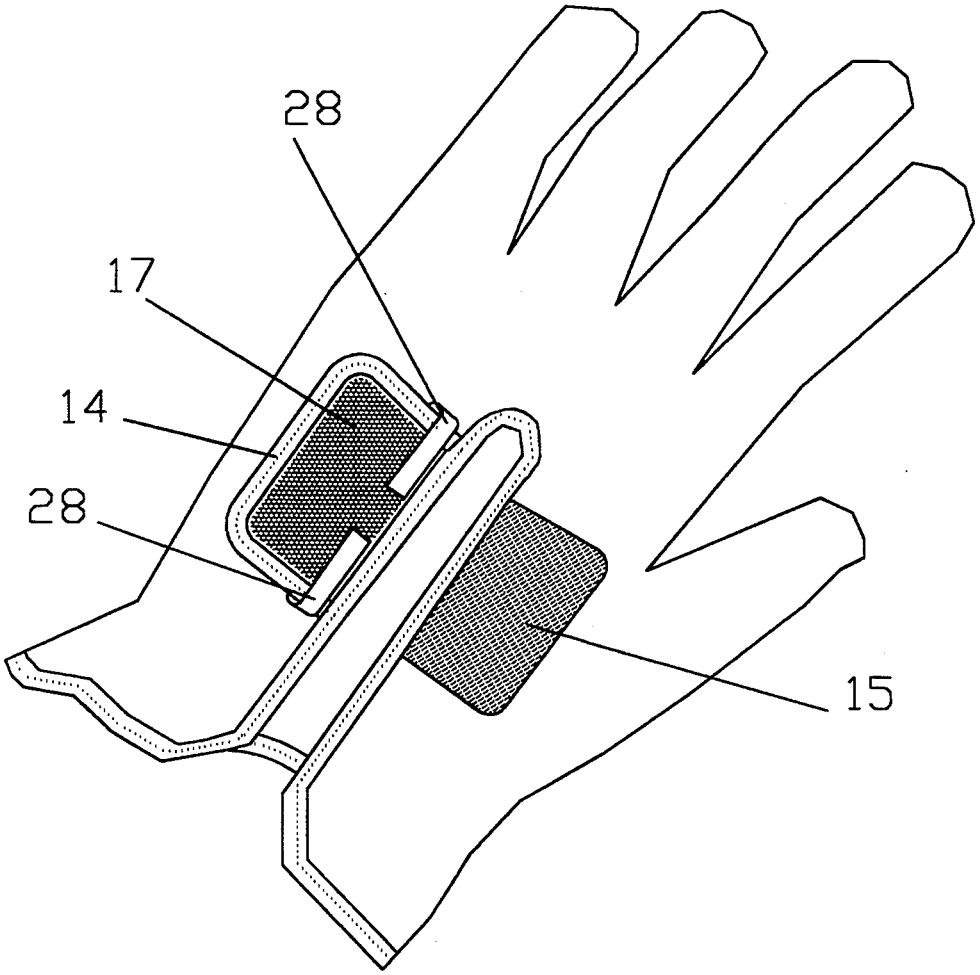
FIG. 5 is a perspective view of a typical sports glove showing the underside of the top strap.

Turning now to the drawings, more particularly to FIGS. 1–4, there is shown a golf glove 10 and golf scoring device 11 combination 12 in accordance with the invention. The golf glove 10, except for the golf scoring device 11 and its associated structure for incorporating it into the golf glove 10, is of conventional structure. A top strap 13 on the glove 10 (FIG. 5) has a layer of VELCRO loop fabric on underside 14 of the top strap 13. A mating layer of VELCRO hooks 15 is provided on the glove 10 beneath the strap 13. The two mating VELCRO layers 14 and 15 serve to fasten the glove 10 around a user's wrist. FIG. 5 shows top strap 13 disengaged from hooks 15.

Figure 1:
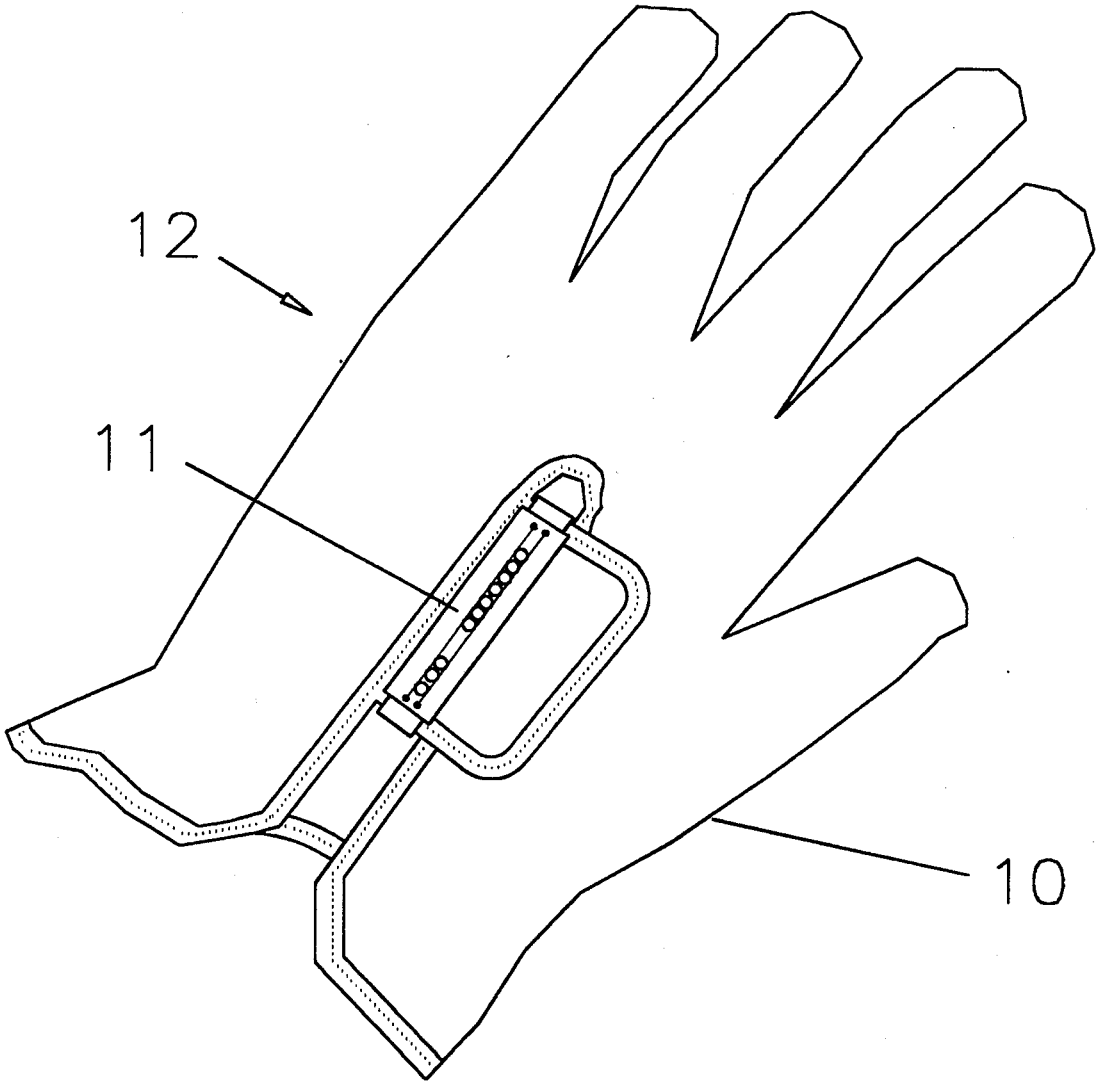
FIG. 1 is a perspective view of a typical golf glove upon which a scoring device is mounted in accordance with the invention.
Figure 2:
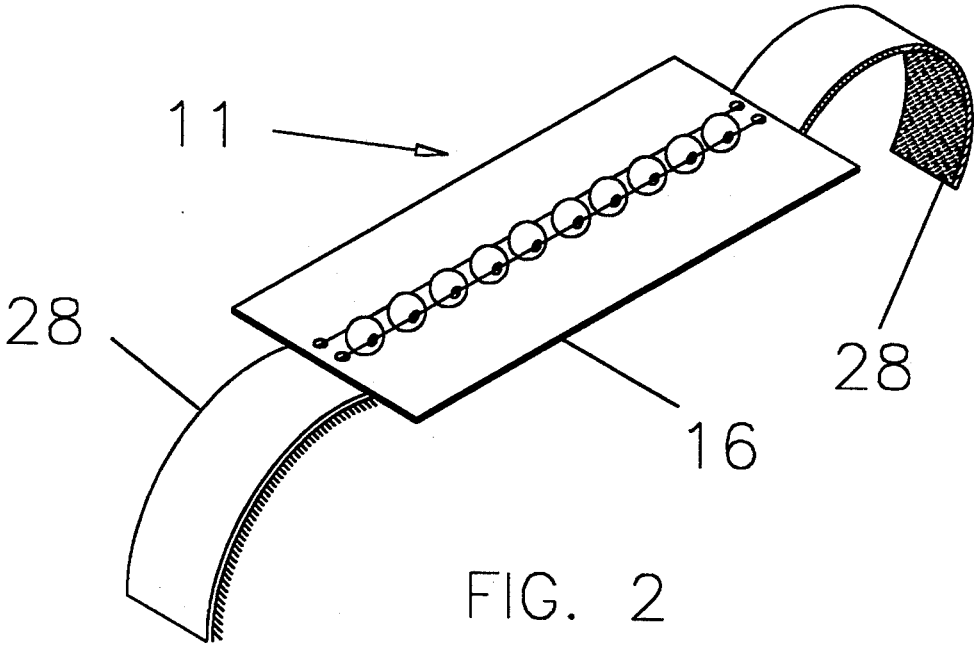
FIG. 2 is a perspective view of a golf scoring device in accordance with the invention.

FIGS. 2 and 3 show a preferred embodiment of the golf scoring device 11 of the invention. Each end 28, of the strap 16, of the scoring device 11, extends partly around top strap 13 of the glove 10, so that ends 28, of the strap 16 engage VELCRO loops 17 on the underside 14 of the strap 13. The strap 16, has VELCRO hooks 22 on its surface facing away from the scoring device 11. With this form of the strap 16, the VELCRO hooks 22 engage the loops 17 of top strap 13 when wrapped around the strap 13. This structure provides a secure attachment of the strap 16, top strap 13, and the golf glove together.

FIG. 3 is an exploded view of the scoring device wherein the various parts including nylon line 18, plastic beads 19, flexible plastic strip 20, adhesive 21, and VELCRO hook 22 are shown. FIG. 4 shows an assembly view of the scoring beads 19 as the beads 19 are strung on nylon line 18. The nylon line 18 is first threaded through holes 23 at approximately the midpoint of line 18 and then strung through the bead holes 23' as shown in FIG. 4. The nylon line 18 is inserted in end holes 24 of plastic strip 20 and knotted as at 25, underneath the plastic strip 20. Sufficient space remains between the beads 19 as they are strung to provide sufficient space between the beads 19 which are counted and those to be counted.

Figure 6:
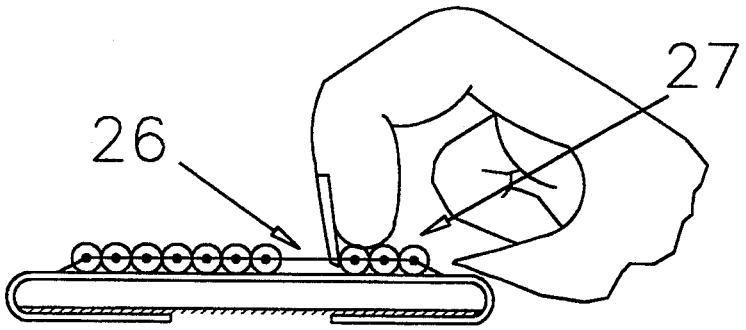
FIG. 6 is a perspective view of a scoring device of the invention in operation.

The beads 19 are moved with the fingertip as shown in FIG. 6. As each stroke is taken, the golfer slides a bead 19 from the starting end 26 towards the finishing end 27. When the hole is completed, the number of beads 19 pertaining to the number of strokes taken are totaled and recorded on the golfer's scorecard. The beads 19 are then moved toward the starting end 26 before the next hole is started. FIG. 4 shows three beads 19 indicating three strokes with the balance of seven beads remaining.

Figure 7:
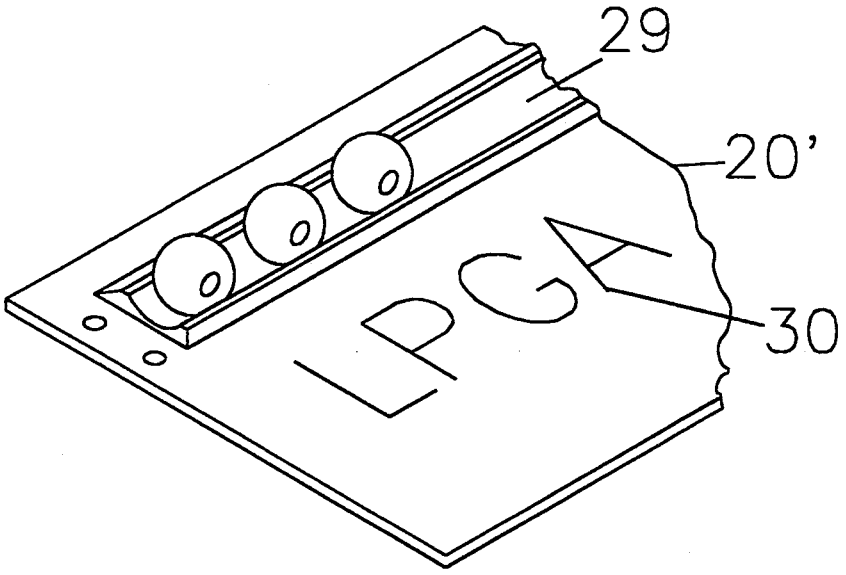
FIG. 7 is a detailed view, partially in section, of a bead track in accordance with a second embodiment of the invention.
Figure 8:
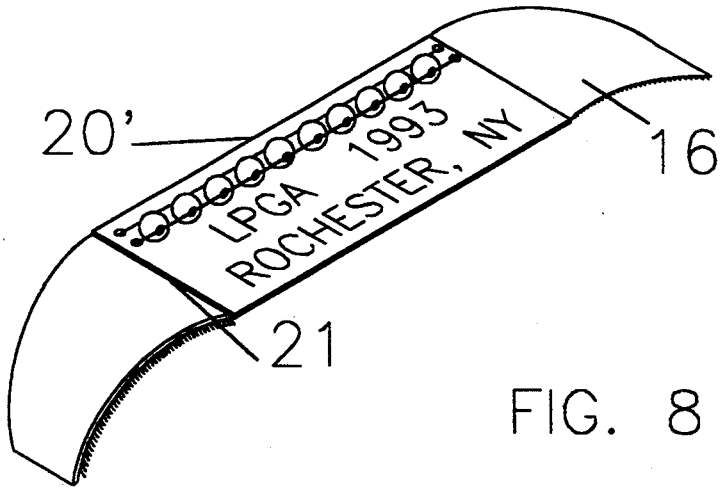
FIG. 8 is a perspective view of a second embodiment of the invention.
Figure 9:
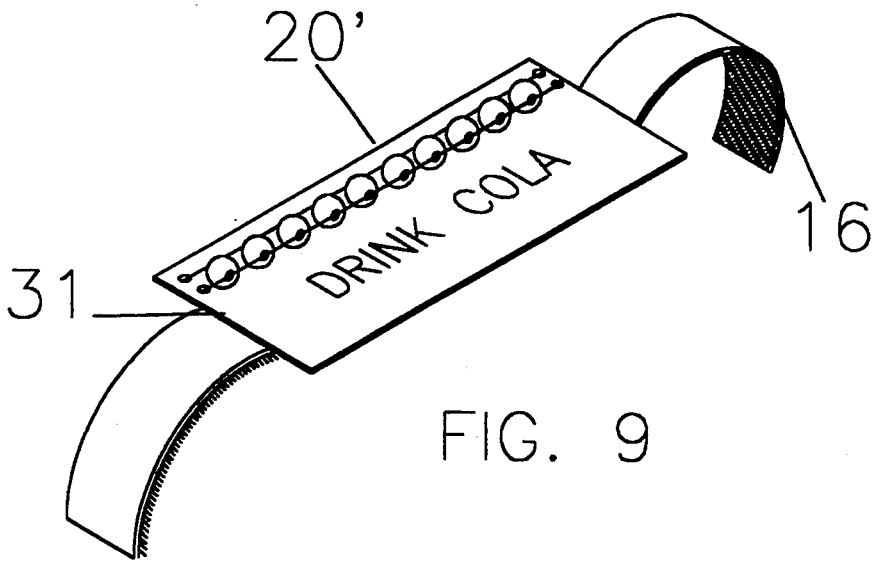
FIG. 9 is a perspective view of a third embodiment of the invention.

FIG. 7 shows a variation in the design of plastic strip 20 as designated by 20'. Plastic strip 20' contains a channel-like groove 29 and promotional material 30 molded therein. The channel-like groove 29 confines the beads 19 to a single narrow track and permits the beads 19 to conveniently roll in a constrained manner. Furthermore, having a slightly oversize (wide) plastic strip 20' provides an area which may be used to print promotional messages, logos, Country Club identification, etc. FIG. 8 shows plastic strip 20' affixed to strap 16 with an adhesive strip 21. FIG. 9 shows plastic strip 20' having slots 31 at each end and strap 16 inserted therein rather than being affixed with an adhesive strip 21.

Figure 10:
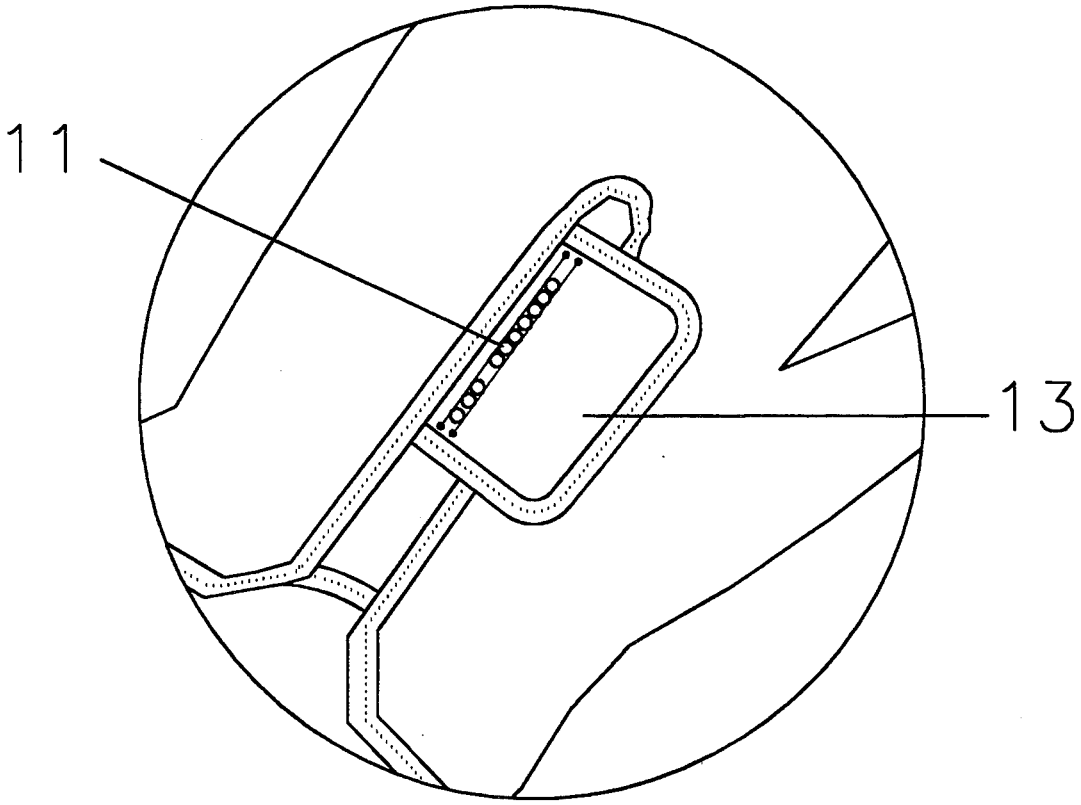
FIG. 10 is a top perspective view of a scoring device affixed directly to a glove tab.

FIG. 10 is a perspective view of a golf scoring device 11 assembled and affixed directly to the top strap 13 of glove 10 to become an integral part of glove 10 during its manufacture. Also shown are two alternate locations for the scoring device 11.

Figure 11:
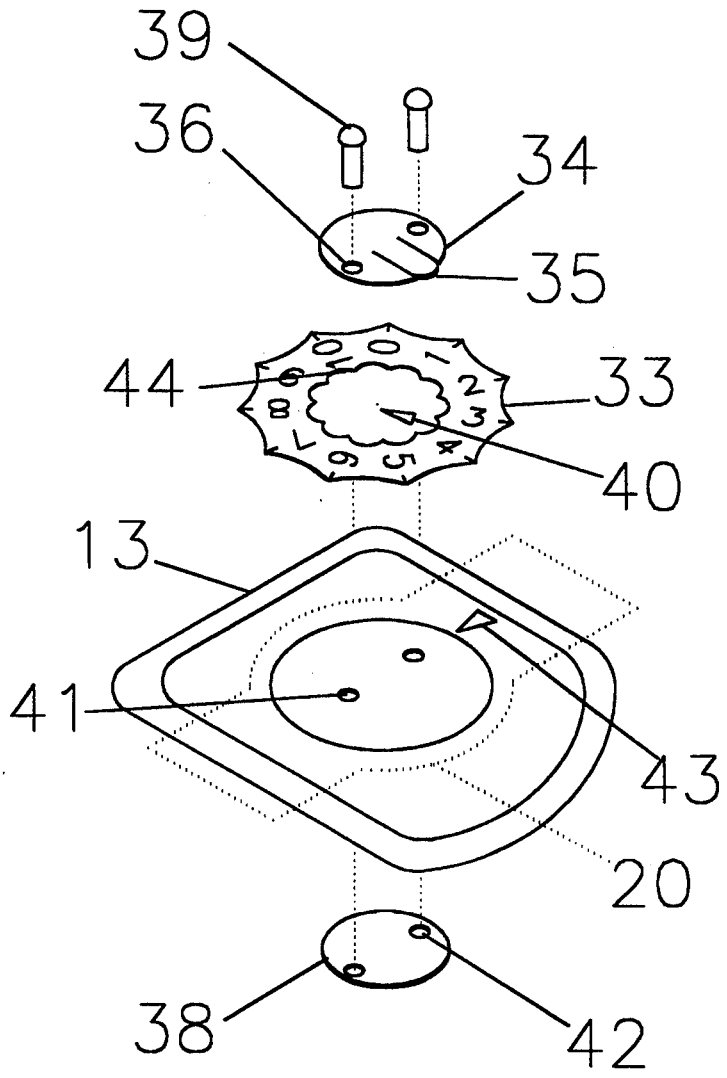
FIG. 11 is a perspective exploded view of a rotary scoring embodiment of the invention attached directly to the glove tab.
Figure 12:
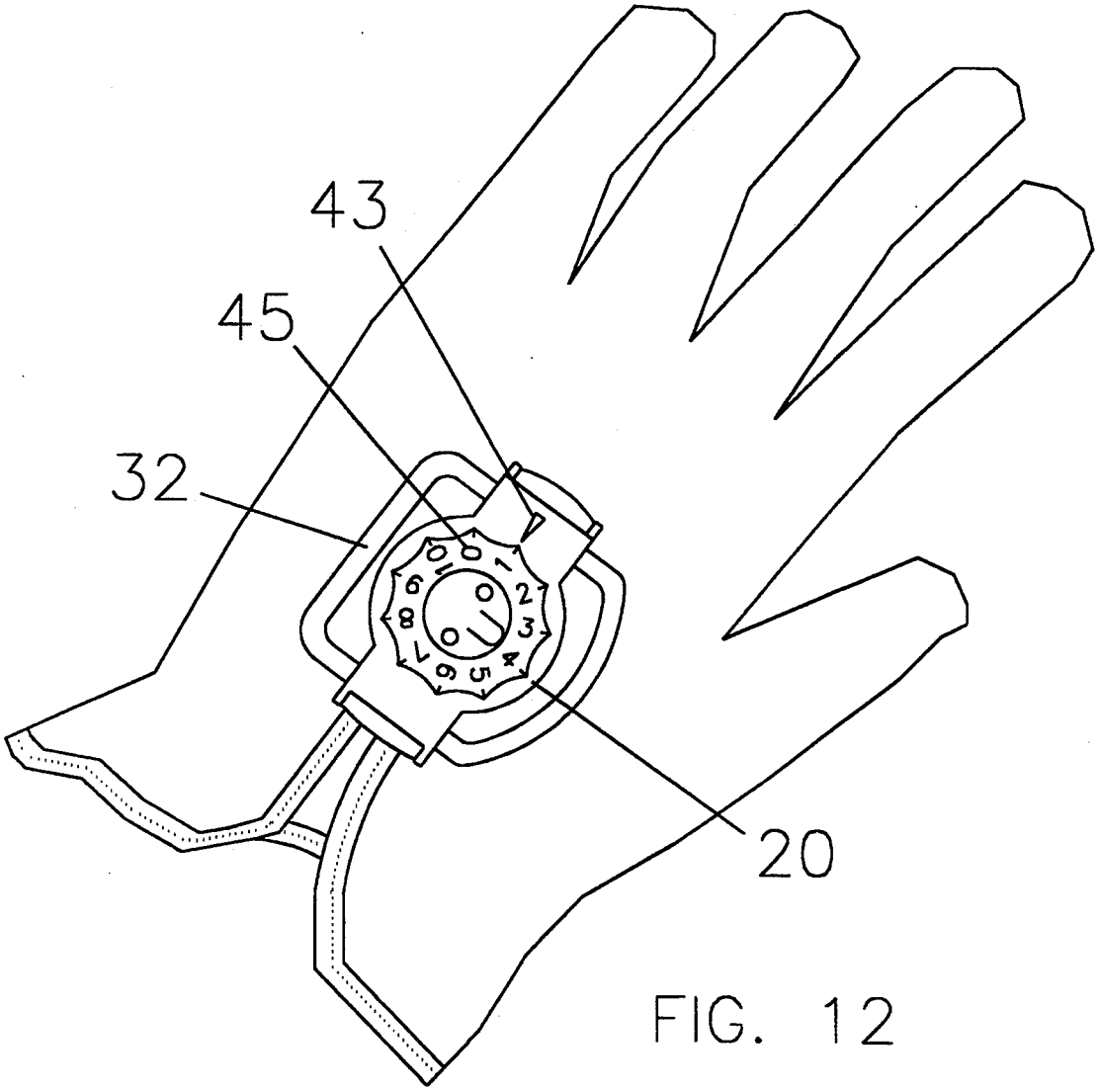
FIG. 12 is an assembly of a rotary scoring device attached to a VELCRO strap affixed to the tab of a golf glove.

FIG. 11 is a perspective exploded view of a rotary scoring device 32 embodiment of the invention. The rotary scoring device 32 comprises a rotary numbered dial disc 33 held in place and rotating around the lower side of base 34. Base 34 contains a flexible tab 35 and two mounting holes 36. A plastic disc 37 is assembled beneath dial disc 33 directly on the top strap 13 or VELCRO strap 16 as assembled in FIG. 12. Completing the assembly is plastic disc 38 assembled to the underside (VELCRO) side of top strap 13 or VELCRO strap 16 with rivets 39. Rivets 39 are inserted in holes 36, through the opening 40 in dial disc 33, through holes 41, through holes (not shown) punched in strap 13 or 16, through holes 42 in disc 38. An indicator indicia 43 is located on the strap 13 and removable strap 16 as shown.

The dial disc 33 contains detents 44 around the periphery of opening 40. Tab 35 of base 34 engages a single detent 44 as the dial disc 33 is rotated to record a stroke. As the disc 33 is rotated to position a number 45 corresponding to a stroke, the tab 35 flexes upwardly and permits the dial disc 33 to index one space to the next stroke to be indicated by indicator 43.

Thus a scoring device has been described that may be conveniently, detachably or fixedly assembled to the strap of a golf glove without adding hindering weight or physical size which would be distracting visually or physically. A fingernail of the other hand is used to slide a bead or turn a disc from its resting position after each stroke. As an independent unit, this scoring device is easily transferable from a worn out glove to a new replacement glove using the VELCRO attaching means. The design is also capable of easily being made an integral part of the glove as the glove is being manufactured.

Although other means of indexing and attachment are possible, the beads and disc of this invention tend to stay in place irregardless of any glove movement or shock. It should be understood, however, that the invention has been illustrated only in two specific forms. Many modifications, additions, and deletions may be made thereto without departure from the scope of the invention as set forth in the following claims.

What is claimed is:

1. In combination, a glove, a golf scoring device, and means for attaching and detaching said scoring device to and from said glove, said glove having a flap joined by a first end to said glove, said flap having a loop fabric strip affixed on the side facing said glove, said glove having a fabric hook strip affixed to said glove beneath said flap, said golf scoring device comprising:

a fabric hook strip, and a flexible plastic strip having plastic beads strung together and connected thereto by a linkage of nylon thread, said nylon thread being inserted in end holes of said flexible plastic strip and knotted and said flexible plastic strip being affixed to said fabric hook strip with adhesive, and means for attaching and detaching said scoring device to and from said glove comprising extending said fabric hook strip partly around said glove flap and attaching said fabric hook strip to said fabric loop strip of said glove flap and then fastening said loop fabric strip of said glove to said fabric hook strip fastened to said glove beneath said flap.

* * * * *